US005506773A

United States Patent [19]

Takaba et al.

[11] Patent Number: 5,506,773

[45] Date of Patent: Apr. 9, 1996

[54] SELF-DIAGNOSING APPARATUS FOR MOTOR VEHICLES

[75] Inventors: Katsumi Takaba, Obu; Takahide Abe, Kariya; Takehiro Abeta, Obu, all of Japan

[73] Assignee: Nippondenso Co., Ltd., Kariya, Japan

[21] Appl. No.: 211,604

[22] PCT Filed: Jul. 22, 1993

[86] PCT No.: PCT/JP93/01026

§ 371 Date: Apr. 7, 1994

§ 102(e) Date: Apr. 7, 1994

[87] PCT Pub. No.: WO94/04809

PCT Pub. Date: Mar. 3, 1994

[30] Foreign Application Priority Data

Aug. 11, 1992 [JP] Japan ..... 4-235348
Aug. 26, 1992 [JP] Japan ..... 4-250694

[51] Int. Cl.[6] ..... F02D 45/00

[52] U.S. Cl. ..... 364/424.03; 364/424.04; 364/431.01; 364/551.01; 340/438

[58] Field of Search ..... 364/424.03, 424.04, 364/431.01, 431.04, 550, 551.01; 340/438, 439; 73/117.2, 117.3

[56] References Cited

U.S. PATENT DOCUMENTS 4,307,455 12/1981 Juhasz et al. ..... 364/424.04
4,635,214 1/1987 Kasai et al. ..... 364/551.01
5,173,856 12/1992 Purnell et al. ..... 340/439
5,191,529 3/1993 Ramsey et al. ..... 364/424.04
5,227,766 7/1993 Endo ..... 364/424.03
5,276,619 1/1994 Ohara et al. ..... 364/424.04
5,388,045 2/1995 Kamiya et al. ..... 364/424.03

FOREIGN PATENT DOCUMENTS 62-142849 6/1987 Japan .
63-90738 4/1988 Japan .
3-92564 4/1991 Japan .

*Primary Examiner*—Gary Chin
*Attorney, Agent, or Firm*—Cushman, Darby & Cushman

[57] ABSTRACT

A control unit 1 has a CPU 101 and a backup RAM 102. The CPU 101 detects diagnostic data necessary for analyzing malfunctions of instruments installed in a motor vehicle, and updates and stores the data in sequence in the backup RAM 102 so that when malfunctions are detected, the CPU 101 inhibits updating and storing of the diagnostic data. Further, the control unit stores the malfunction detection history before the updating and storing inhibiting operation immediately after the malfunction has been detected. Therefore, even if an ignition switch is turned off before the updating and storing inhibiting operation, the malfunction detection history is referenced after the ignition switch is turned on again; when there is a detection history, the updating of the diagnostic data is inhibited so that the diagnostic data is prevented from being reset by mistake when the power supply is turned on again. A CPU 61 of a control unit 51 sets a flag bit at a predetermined position in a RAM 63 when malfunctions of the instruments installed in the motor vehicle are detected and then stores the malfunction code and the diagnostic data. When all the diagnostic data is stored, the flag bit is reset. Since the flag bit is not reset if the power supply is shut off while the diagnostic data is being stored, the diagnostic data can be prevented from being erroneously read out by confirming the setting/non-setting of the flag bit when the diagnostic data is read out.

14 Claims, 18 Drawing Sheets

FIG. 5

| |
|---|
| MALFUNCTION CODE |
| NUMBER OF ROTATIONS OF ENGINE |
| WATER TEMPERATURE OF ENGINE |
| INTAKE AIR TEMPERATURE |
| THROTTLE OPENING |
| VEHICLE SPEED |
| ENGINE LOAD |
| RATE OF FLUCTUATION OF ENGINE SPEED |
| |
| |
| |

SELF-DIAGNOSING APPARATUS FOR MOTOR VEHICLES

TECHNICAL FIELD

The present invention relates to a self-diagnosing apparatus for motor vehicles which stores diagnostic data necessary for analyzing malfunctions of instruments installed in such motor vehicle.

BACKGROUND ART

At the present time the construction of motor vehicles has become remarkably electronic. Instruments, including, among other things, the engine, installed in each section of a motor vehicle are interconnected via a control computer so that complex operations can be performed.

In such a case, even if a malfunction of a certain single installed instrument is detected, often the true cause cannot be determined because of the interrelationship with other installed instruments unless a wide range of data (diagnostic data) indicating the state of the motor vehicle at the time the malfunction is detected is collected. Also, after a temporary malfunction, there is a possibility that the malfunction will be corrected naturally. Further, often this temporary malfunction is a sign that a complete failure will occur; however, it is quite difficult to find the cause thereof by performing an inspection after getting out of the motor vehicle.

Accordingly, a self-diagnosing apparatus is proposed in Japanese Patent Laid-Open No. 62-142849, in which diagnostic data from each section of a motor vehicle is updated and stored in a memory where the contents are stored at specified intervals even when the power supply is shut down; updating of the contents of the memory being inhibited (frozen) after a malfunction of the installed instrument is detected, so that the cause of the malfunction can be determined accurately after getting out of the motor vehicle.

An apparatus is proposed in Japanese Patent Laid-Open No. 3-92564, in which control programs in addition to the diagnostic data are stored in the memory in order to determine the cause of a malfunction more accurately.

In the above-described conventional apparatuses, since the above-mentioned diagnostic data is stored by a microcomputer operation, it takes some time, though slight, from when a malfunction is detected until data is frozen. If the ignition switch is turned off between the time of malfunction detection and freezing the data, the microcomputer stops its processing, and the diagnostic data obtained before the ignition switch has been turned off is not frozen. Therefore, the diagnostic data is reset to an initial state when the ignition switch is turned on again to start the control program, making it impossible to analyze the malfunction, which is problematical. Also, if the diagnostic data obtained when a malfunction is detected again after the ignition switch is turned on again is frozen despite the first detection of the malfunction before the ignition switch has been turned off, diagnostic data (data obtained when the ignition switch is turned on again) different from that when the first malfunction has occurred, will be output. As a result, there is a risk that the cause of the malfunction will be analyzed erroneously, or it will become impossible to investigate the cause of the malfunction.

In the above-described conventional apparatuses, the diagnostic data is stored and updated in the memory at regular intervals up to the time a malfunction occurs. This storing and updating becomes a burden depending upon the computing speed of the CPU, and it is conceivable that the diagnostic data is stored and frozen only after the occurrence of the malfunction is detected.

However, there is a problem in that if the ignition switch is turned off during the time from when the malfunction is detected until when all the diagnostic data is completely stored, since non-updated erroneous data remains, new and old data are present when the diagnostic data is output, causing an erroneous analysis of the malfunction. To prevent this erroneous analysis, it is conceivable that a main relay for supplying power to the CPU for some time after the ignition switch has been turned off is disposed. This results in increased cost because of the addition of hardware.

The present invention solves the above-described problems of the prior art. It is an object of the present invention to accurately analyze the cause of a malfunction even when the power supply is shut off immediately after the malfunction is detected.

It is another object of the present invention to prevent problems, such as erasure of diagnostic data as a result of the power supply being shut off, storing of erroneous diagnostic data, outputting of erroneous diagnostic data, or erroneous analysis on the basis of erroneous diagnostic data, by first storing the fact that a malfunction is detected immediately after detection in order to make it possible to confirm, when the supply of power is restarted, the fact that the power supply has been shut off during the malfunction detecting operation and the diagnostic data operation process after the detecting operation.

DISCLOSURE OF THE INVENTION

The construction of the present invention will now be explained with reference to FIG. 9. The present invention comprises diagnostic data detecting means for detecting diagnostic data necessary for analyzing malfunctions of instruments installed in a motor vehicle; malfunction detecting means for detecting the malfunction of instruments installed in a motor vehicle; malfunction detection history storing means for storing the malfunction detection history of the malfunction detecting means and holding the storage thereof even when an ignition switch is off; diagnostic data storing means for storing diagnostic data detected by the diagnostic data detecting means after the malfunction of the instruments installed in the motor vehicle is detected and holding the storage thereof even when the ignition switch is off; and updating inhibiting means for inhibiting the updating of diagnostic data stored in the diagnostic data storing means when the detection history stored in the malfunction detection history storing means is referenced after the ignition switch is turned on and when there is a detection history.

If the ignition switch is turned off while data is being updated after a malfunction has been detected, the diagnostic data of the storing means is lost by initialization reset when the ignition switch is turned on next. In the above-described construction, the malfunction detection history before the ignition switch is turned on is referenced; when there is a detection history, the updating of the diagnostic data is inhibited. Therefore, the diagnostic data will not be reset erroneously.

According to the self-diagnosing apparatus for motor vehicles of the present invention, as described above, the diagnostic data when the previous malfunction has been detected will not be erroneously reset when the power supply is turned on again.

The construction of the present invention will now be explained with reference to FIG. 18. The present invention comprises means for detecting the malfunction of each instrument installed in a motor vehicle; storing means for holding the contents when the ignition switch is in an off state; means for storing diagnostic data necessary for setting a flag bit in a predetermined position of the storing means when an instrument malfunction is detected and storing diagnostic data necessary for analyzing later the malfunctions of instruments; and means for resetting the flag bit after all the diagnostic data is stored.

In the above-described construction, the flag bit is set prior to the storing of the diagnostic data when a malfunction is detected. Since this flag bit is reset after all the diagnostic data is completely stored, if the power supply is shut off while the diagnostic data is being stored, the flag bit will not be reset. Therefore, if the setting/non-setting of the flag bit is confirmed when diagnostic data is read out, erroneous diagnostic data will not be read out.

According to the self-diagnosing apparatus for motor vehicles of the present invention, as described above, when the power supply is shut off while the diagnostic data is being stored, this turning-off is determined on the basis of the setting/non-setting of the flag bit, so that the reading of erroneous diagnostic data can be reliably avoided.

BRIEF DESCRIPTION OF THE DRAWINGS

FIG. 5 is an illustration of the memory configuration of a standby RAM in accordance with the first embodiment of the present invention;

DETAILED DESCRIPTION OF PRESENTLY PREFERRED EMBODIMENTS

Best Mode for Carrying Out the Invention

A first embodiment of the present invention will now be explained.

In the first embodiment, immediately after a malfunction occurs, the malfunction occurrence is stored temporarily, and then updating of diagnostic data which has been updated and stored in sequence is inhibited. After the ignition switch is turned on and before the diagnostic data is updated and stored, it is first confirmed that the diagnostic data is temporarily stored. When the diagnostic data has been temporarily stored, further updating and storing is inhibited. As described above, in this first embodiment, the fact that the storing of the diagnostic data is not terminated because the power has been shut off by the ignition switch immediately after the malfunction occurred, can be confirmed by the presence of the above-described temporary storage. Since in this first embodiment, updating and storing is inhibited once again after the ignition switch is turned on again, it is possible to store diagnostic data when a malfunction occurs, making it possible to accurately analyze the malfunction.

Figure 1:
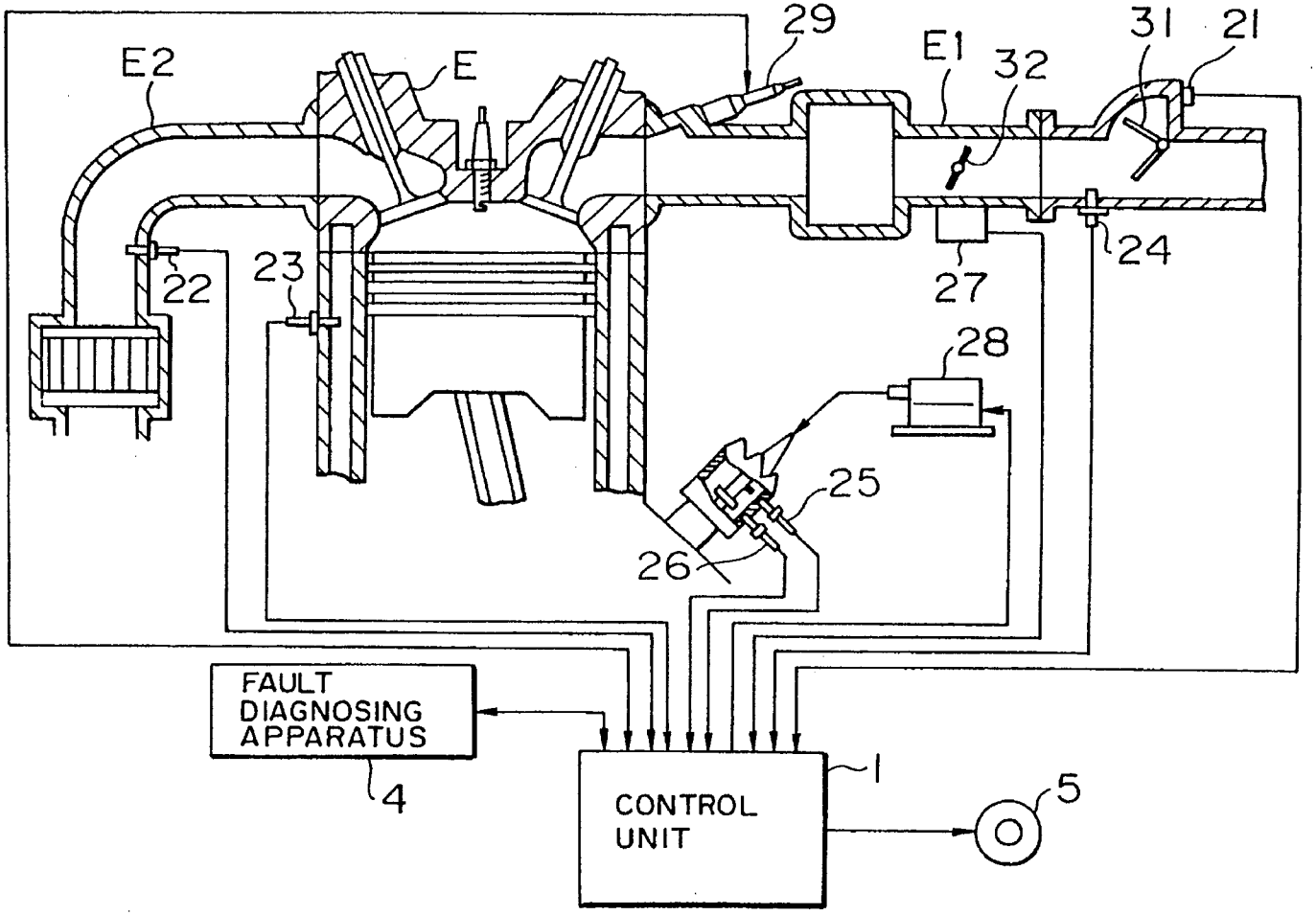
FIG. 1 is an illustration of the entire construction of a self-diagnosing apparatus in accordance with a first embodiment of the present invention.
Figure 2:
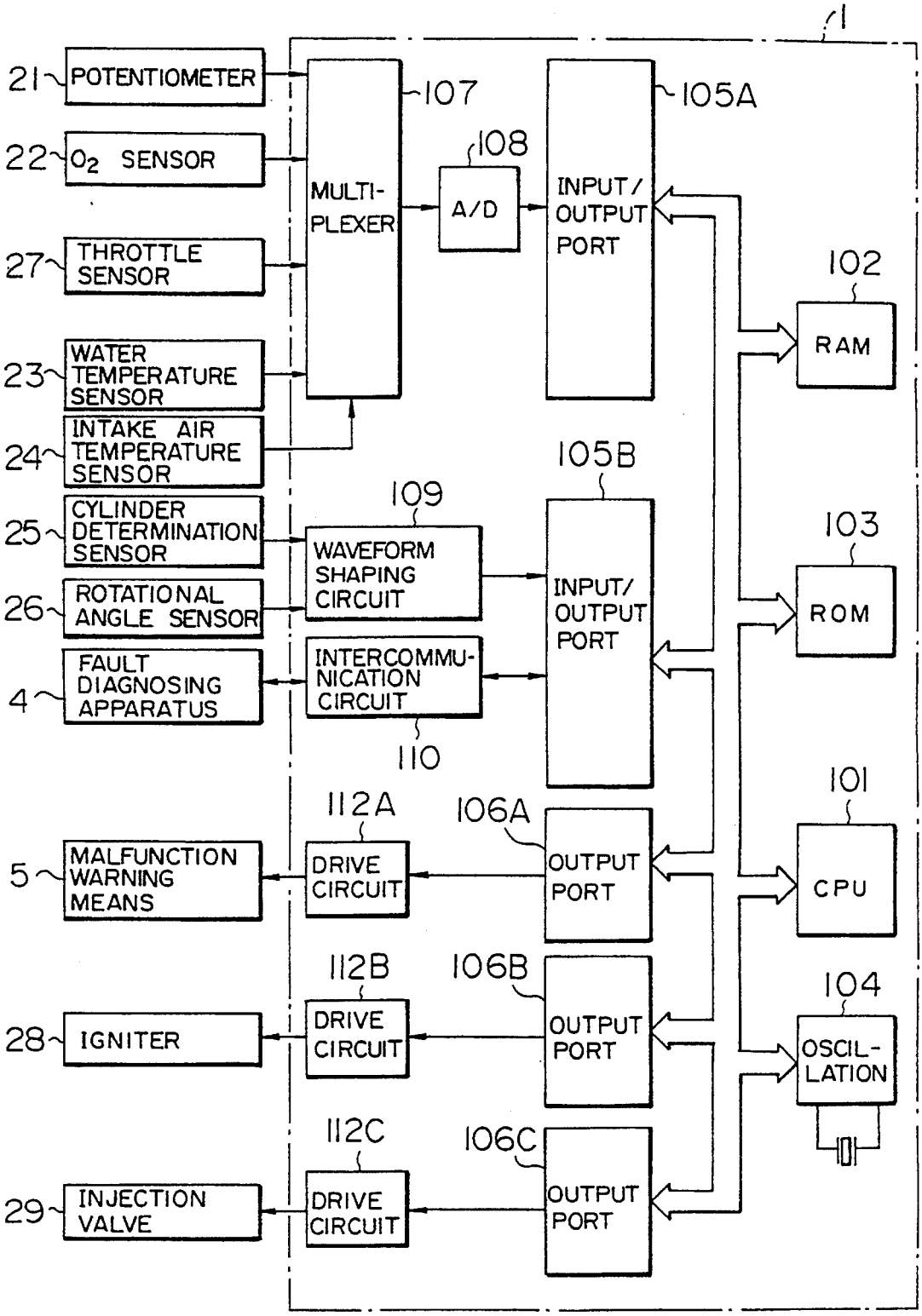
FIG. 2 is a block diagram of a control unit in accordance with the first embodiment of the present invention.

In FIGS. 1 and 2, a potentiometer 21 of a flow meter 31, an intake-air temperature sensor 24, a throttle sensor 27 of a throttle valve 32, and a fuel discharge valve 29 are disposed in the upstream portion of an intake-air pipe E1 of an engine E. A water temperature sensor 23 is disposed in a water jacket of the engine E, and an 02 sensor 22 is disposed in a discharge pipe E2 of the engine E.

A control unit 1 having a CPU 101 contained therein is disposed, and the CPU 101 is connected via a data bus to a RAM 102, a ROM 103, an oscillation circuit 104, input/output ports 105A and 105B, and output ports 106A, 106B, and 106C. The RAM 102 is separated into a common RAM for temporary storage and a standby RAM in which the contents at the time the ignition key is turned off are held.

Output signals from the potentiometer 21, the 02 sensor 22, the water temperature sensor 23, the intake-air temperature sensor 24 and the throttle sensor 27 are input through a multiplexer 107 and an A/D converter 108 to the input/output port 105A. Output signals from a cylinder determination sensor 25 and a rotational angle sensor 26 are input through a waveform shaping circuit 109 to the input/output port 105B.

The output signals are supplied via output ports 106B and 106C to an igniter 28 and the fuel discharge valve 29.

When a malfunction of each of the above-mentioned instrument installed in a motor vehicle is detected by a sequence to be described later, an output signal is issued to a malfunction warning means 5 through the output port 106A and a drive circuit 112A. As will be described later, diagnostic data necessary for analyzing instrument malfunctions are exchanged via the input/output port 105B and an intercommunication circuit 110 with a fault diagnosing apparatus 4.

Figure 3:
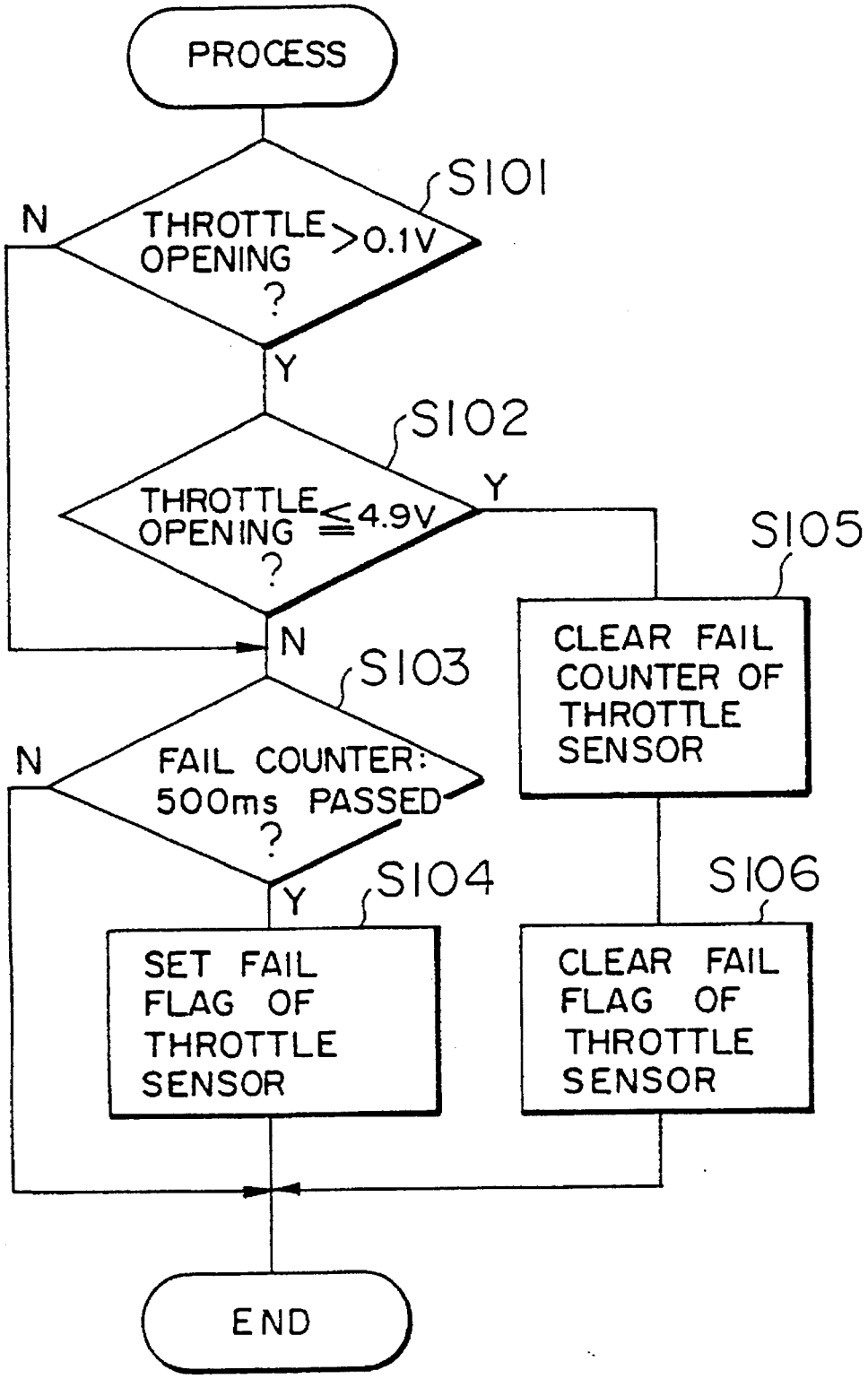
FIG. 3 is a program flowchart of a first embodiment.

FIG. 3 shows a program for detecting a malfunction of the throttle sensor 27. In S101, a check is made to determine whether a throttle opening signal is in the range from 0.1 V to 4.9 V (S101, S102). If the signal is in this range, the fail counter is cleared, and the fail flag in the common RAM is cleared (S105, S106). If, on the other hand, the time during which the signal is not present in the above-mentioned range exceeds 500 ms (S103), it is assumed that the throttle sensor has a malfunction, and the fail flag is set (S104).

Figure 4:
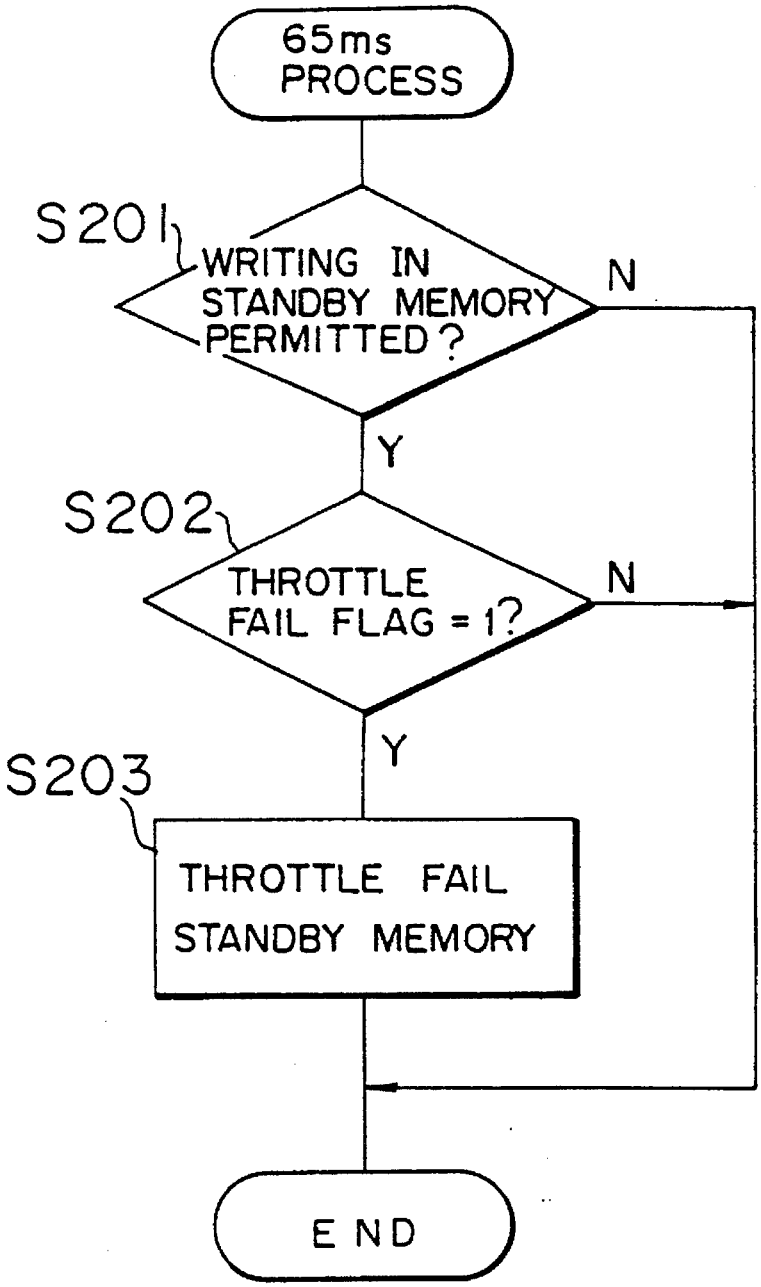
FIG. 4 is a program flowchart of the first embodiment.

FIG. 4 shows a program for inputting into the standby RAM the fact that the above-mentioned fail flags are set, which program is activated at intervals of every 65 ms. In S201, a check is made to determine whether writing in the standby RAM is possible. When the fail flag has been set, predetermined bits of the standby RAM are set (S202, S203), so that the fact that a specific instrument malfunctions has been detected is stored.

The memory configuration of the standby RAM is shown in FIG. 5. Diagnostic data, such as the number of rotations of the engine or water temperature of the engine, are stored in sequence in corresponding addresses within the frame. An abnormality code indicating the type of the malfunction is set at the beginning address thereof as described later.

Figure 6:
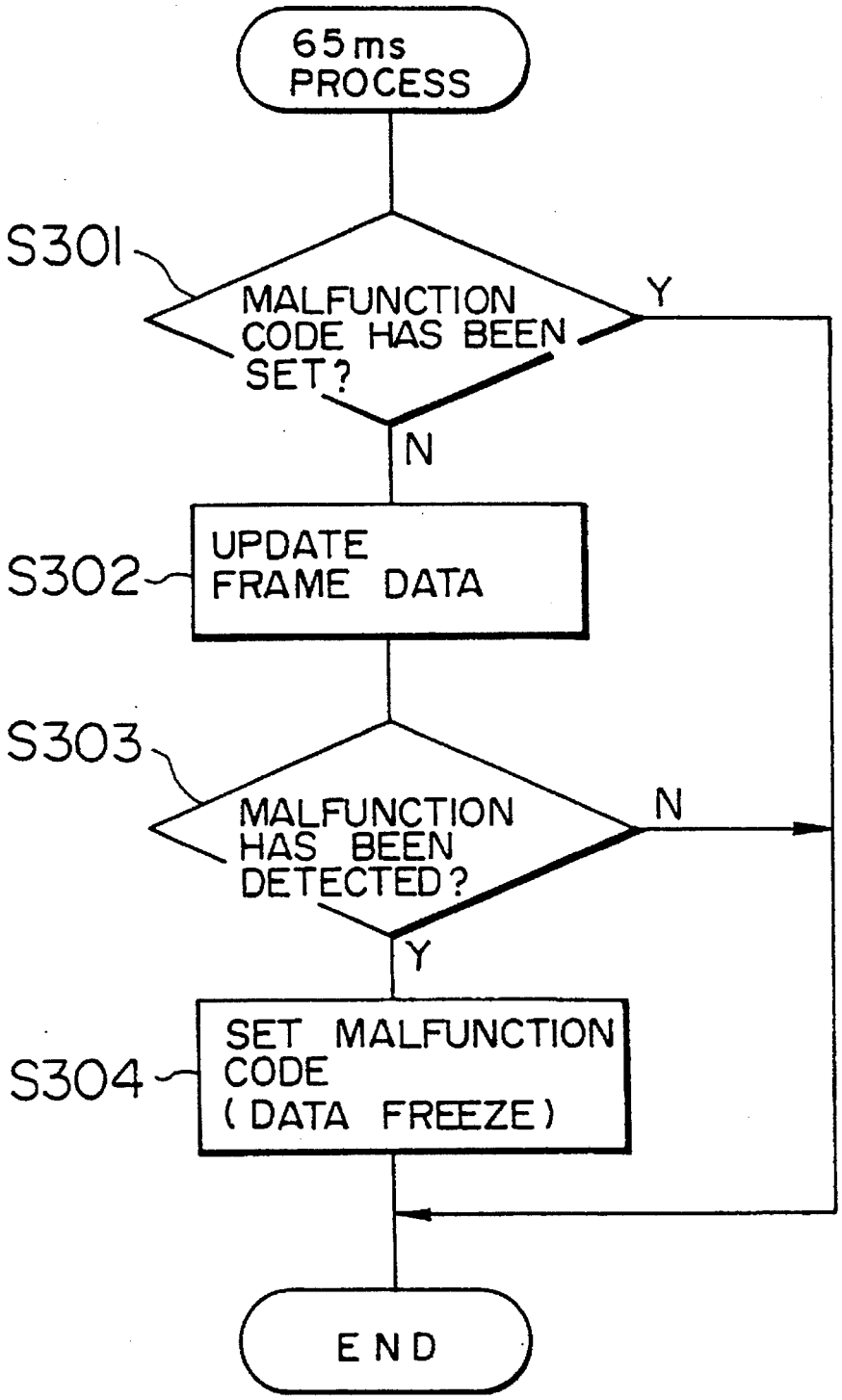
FIG. 6 is a program flowchart of the first embodiment.

FIG. 6 shows a program for controlling writing in the standby RAM. The program is activated at intervals of every 65 ms. In S301, a check is made to determine whether the malfunction code has been set. If the code has not been set, the diagnostic data stored in the previous cycle is updated into the newly input diagnostic data (S302). When the malfunction code has been set in the predetermined bits of the standby RAM under this condition, it is assumed that a malfunction has been detected and the above-described malfunction code is set (S303, S304). When a malfunction code has been set in S301, updating is inhibited, and the diagnostic data is frozen.

Figure 7:
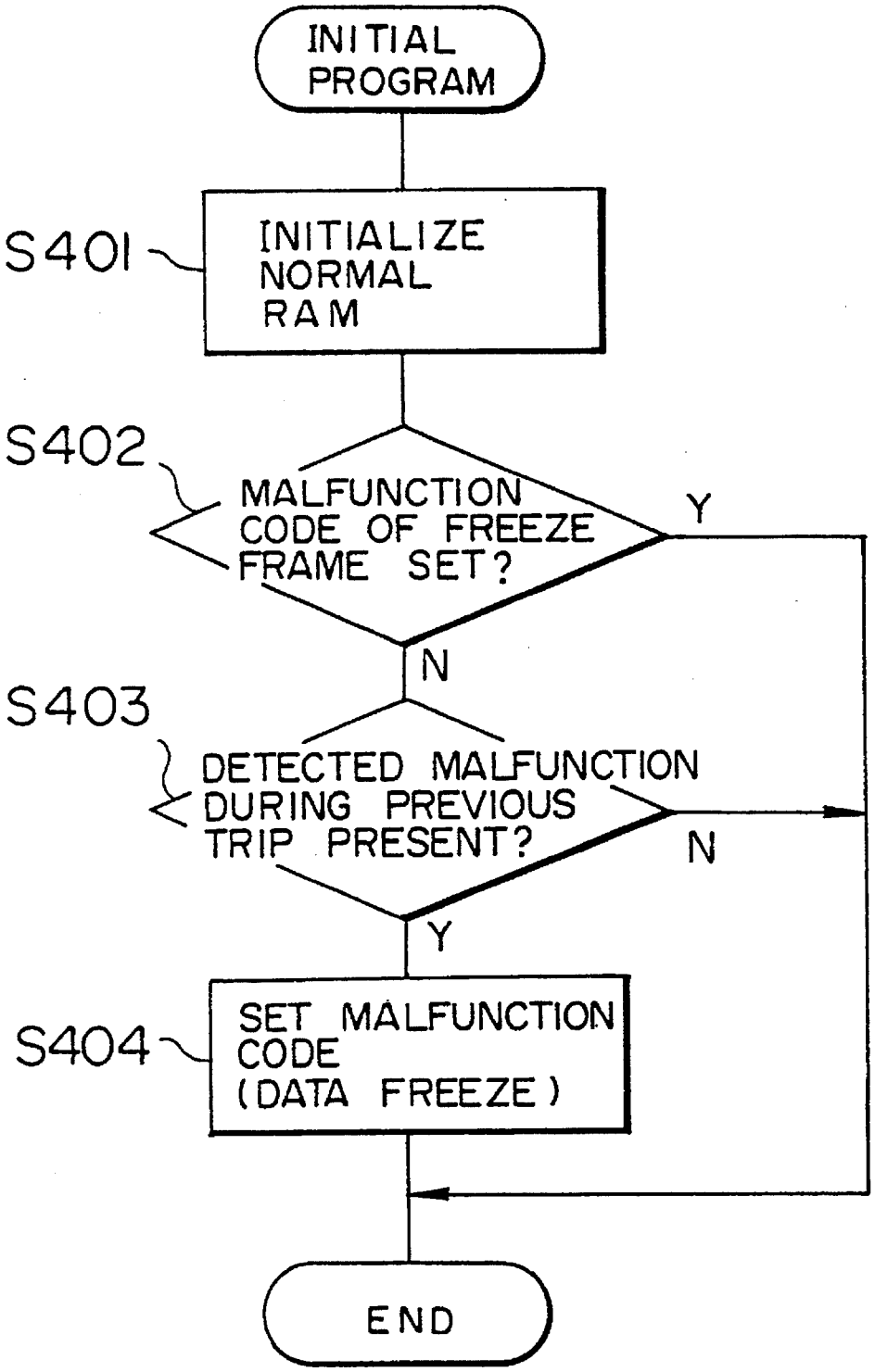
FIG. 7 is a program flowchart of the first embodiment.

FIG. 7 shows an initial program which is executed only once when the ignition switch is turned on. After the common RAM is initialized (S401), it is confirmed whether the malfunction code has been set in the frame (S402). When the malfunction code has been not set, it is confirmed whether the fail flag of the standby RAM has been set (S403). Here, a case in which the malfunction code has not been set and the fail flag has been set indicates that the ignition switch has been turned off after the malfunction while the ignition switch was being turned on (the previous trip) during the previous time and before all diagnostic data has been updated and stored. Therefore, in S404, the malfunction code is set to inhibit the updating of the standby RAM, so that the diagnostic data is placed in the frozen state. As a result, it is possible to prevent the diagnostic data at malfunction time from being set to erroneous data different from the data when a true malfunction occurs by the operation to be performed thereafter shown in FIG. 6.

Figure 8:
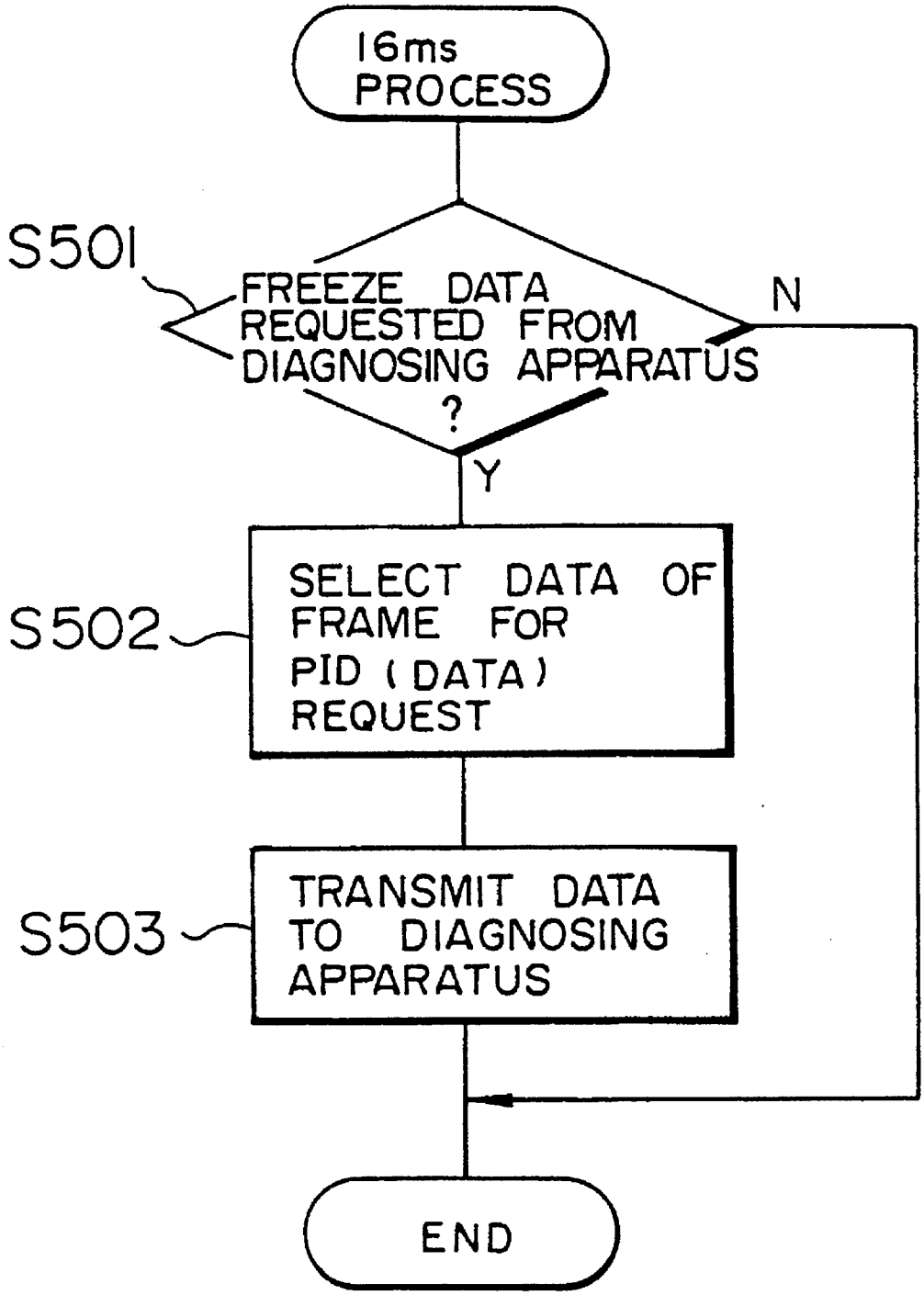
FIG. 8 is a program flowchart of the first embodiment.
Figure 9:
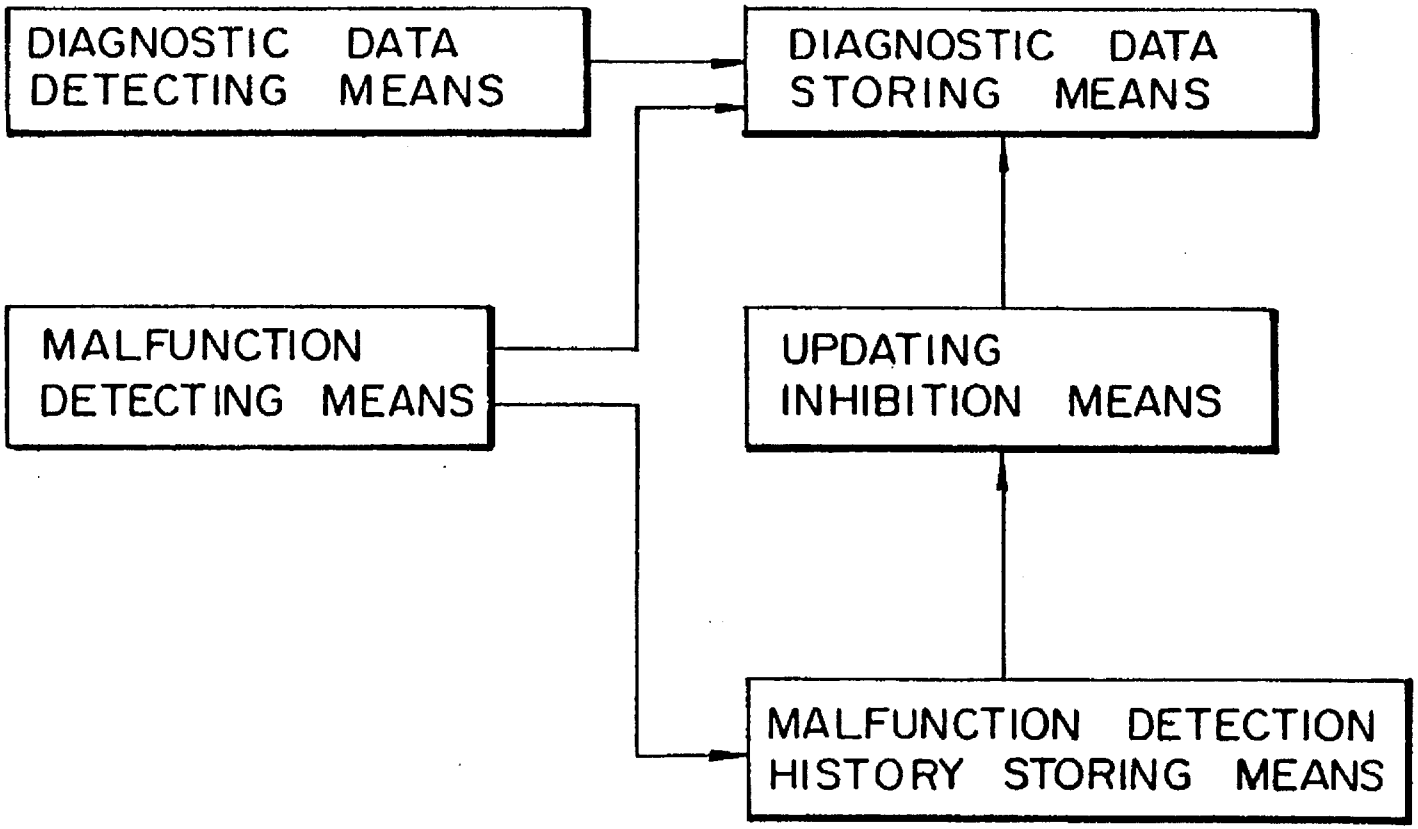
FIG. 9 is a block diagram illustrating the main functions of the first embodiment.

FIG. 8 shows a program for connecting a fault diagnosing apparatus after getting out of the motor vehicle and transmitting diagnostic data, which program is activated every 16 ms. In S501, a check is made to determine if frozen diagnostic data has been requested from the diagnosing apparatus, and diagnostic data for the PID request is selected (S502). Here, the PID request is one in which diagnostic data is requested in an ID format from the diagnosing apparatus. For example, PID1 is the number of rotations of the engine, and PID2 is the speed of the motor vehicle.

As described above, in this embodiment, when a malfunction in the throttle sensor is detected, data indicating the various states of the motor vehicle immediately after the determination are stored. Therefore, analysis of the data stored immediately after the occurrence of the malfunction makes it possible to determine the running state when the malfunction occurred, making it easy to investigate the cause of the fault. Also, in this embodiment, the fail flag is set first in response to the detection of the malfunction, and then data is updated and stored and the malfunction code is stored. The setting/non-setting of the fail flag is determined when the ignition switch is turned on the next time to determine whether a malfunction has occurred previously while the ignition switch was on, inhibiting the updating and storing of data. Therefore, even when the ignition switch is off while data is being updated after a malfunction occurs and the updating of the data is terminated in the middle of the updating, the valuable data updated and stored immediately after the malfunction while the ignition switch is being turned on at the previous time can be prevented from being lost after the ignition switch is turned on the next time.

Although in this embodiment the operation in which only a malfunction occurs in the throttle sensor, it is known that various malfunctions can be detected as regards malfunctions of instruments installed in a motor vehicle, and the present invention can be applied in conjunction with the detection of various malfunctions of instruments installed in a motor vehicle. It may be possible to erase old data before data is updated and stored and then store new data. Even when the ignition switch is turned off while data obtained after a malfunction occurs is being updated and updating of the data is terminated in the middle of the updating operation, it is possible to store only data obtained immediately after the malfunction has occurred. The method for updating and storing data is not limited to one in which the data is updated and stored at predetermined intervals; data may also be updated and stored only when a malfunction is detected. Also, when data is updated and stored at predetermined intervals, data may be stored while cyclically switching sequentially a plurality of storage areas. When a malfunction is detected, updating and storing in all these storage areas is inhibited to freeze the data, so that data obtained immediately after the malfunction is detected, as well as the process leading to the malfunction occurrence can be analyzed.

Next, a second embodiment of the present invention will be explained.

In this second embodiment, a malfunction occurrence is temporarily stored immediately after the malfunction occurs. Thereafter, a plurality of diagnostic data are stored in sequence, and after this storage operation is terminated, the above temporary storage is erased. Thus, the fact can be confirmed that the power supply has been shut off by the ignition switch immediately after the malfunction occurred and that the diagnostic data storing operation has not been terminated. In this second embodiment, outputting of diagnostic data is inhibited when the above-described temporary storage is present, thus preventing erroneous analysis.

Figure 10:
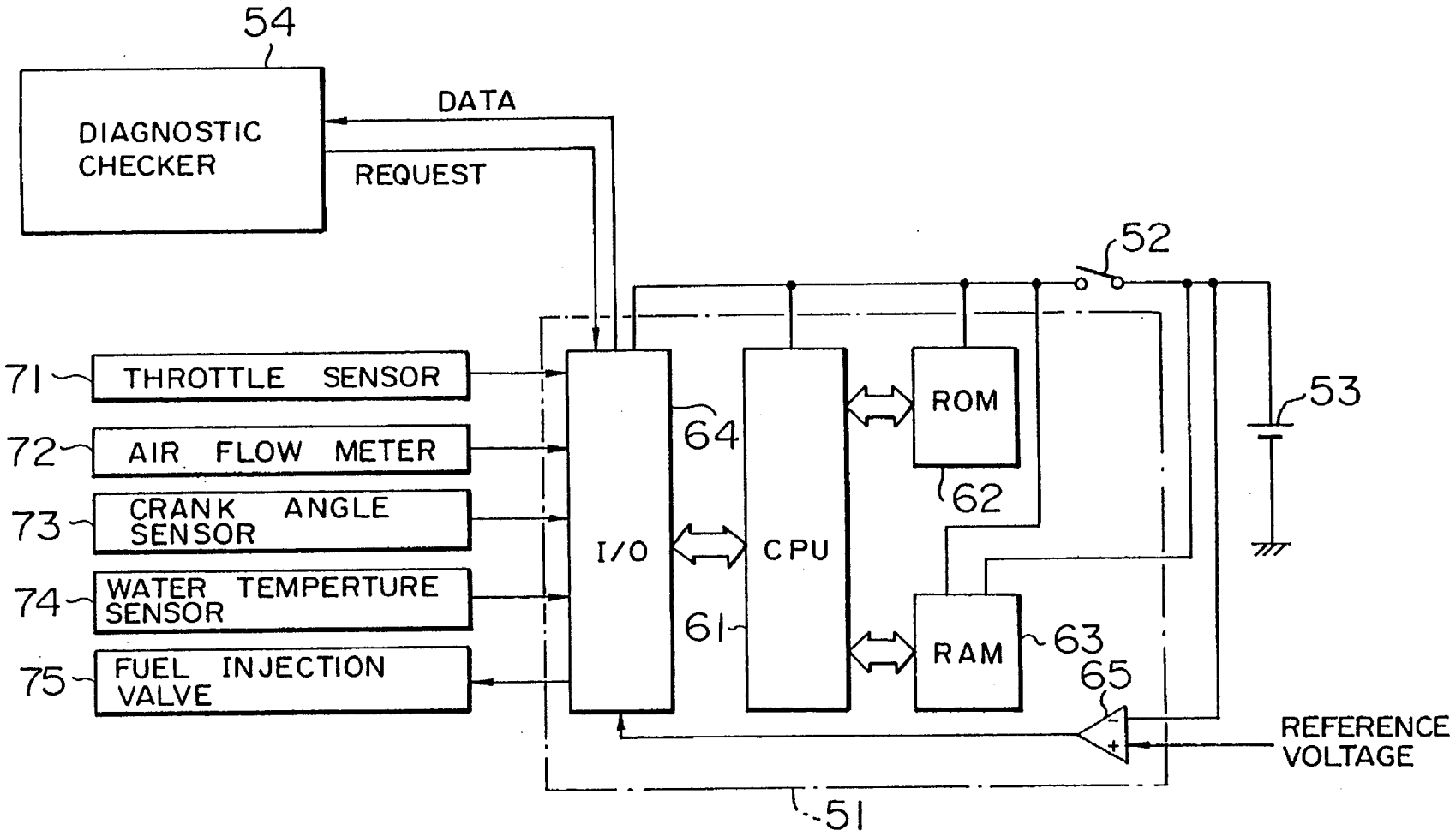
FIG. 10 illustrates the entire construction of a self-diagnosing apparatus in accordance with a second embodiment of the present invention.

FIG. 10 shows the entire construction of the self-diagnosing apparatus. A control unit 51 comprises a CPU 61, a ROM 62, a RAM 63, an input/output (I/O) circuit 64, and a comparator 65. Power is supplied from a battery 53 through an ignition switch 52 to the CPU 61, the ROM 62, the RAM 63 and the I/O circuit 64. Power is directly supplied to a part of the RAM 63 from the battery 53 so that it works as a standby RAM in which the contents of the storage are maintained even when the ignition switch 52 is turned off.

The battery voltage is input to a comparator 65 where it is compared with a reference voltage; this comparison is input to a latch port of the I/O circuit 64. Then, when the battery voltage is decreased, a "1" level output is generated from the comparator 65, causing a voltage decrease latch within I/O circuit 64 to be set.

Sensor signals are input to an I/O circuit 64 from the sensors disposed in the various sections of the motor vehicle, such as a throttle sensor 71, an air-flow meter 72, a crank angle sensor 73, or a water temperature sensor 74. The amount of fuel injected is determined by a CPU 61 in accordance with the sensor signals according to the control programs within a ROM 62. An output signal corresponding to the amount of fuel injected is output through the I/O circuit 64 to a fuel discharge valve 75. These sensor signals are frozen as diagnostic data when a malfunction is detected.

When a malfunction is diagnosed, a diagnostic checker 54 is connected to the I/O circuit 64 as shown in the figure, and the diagnostic data frozen within the RAM 63 is read out.

Figure 11:
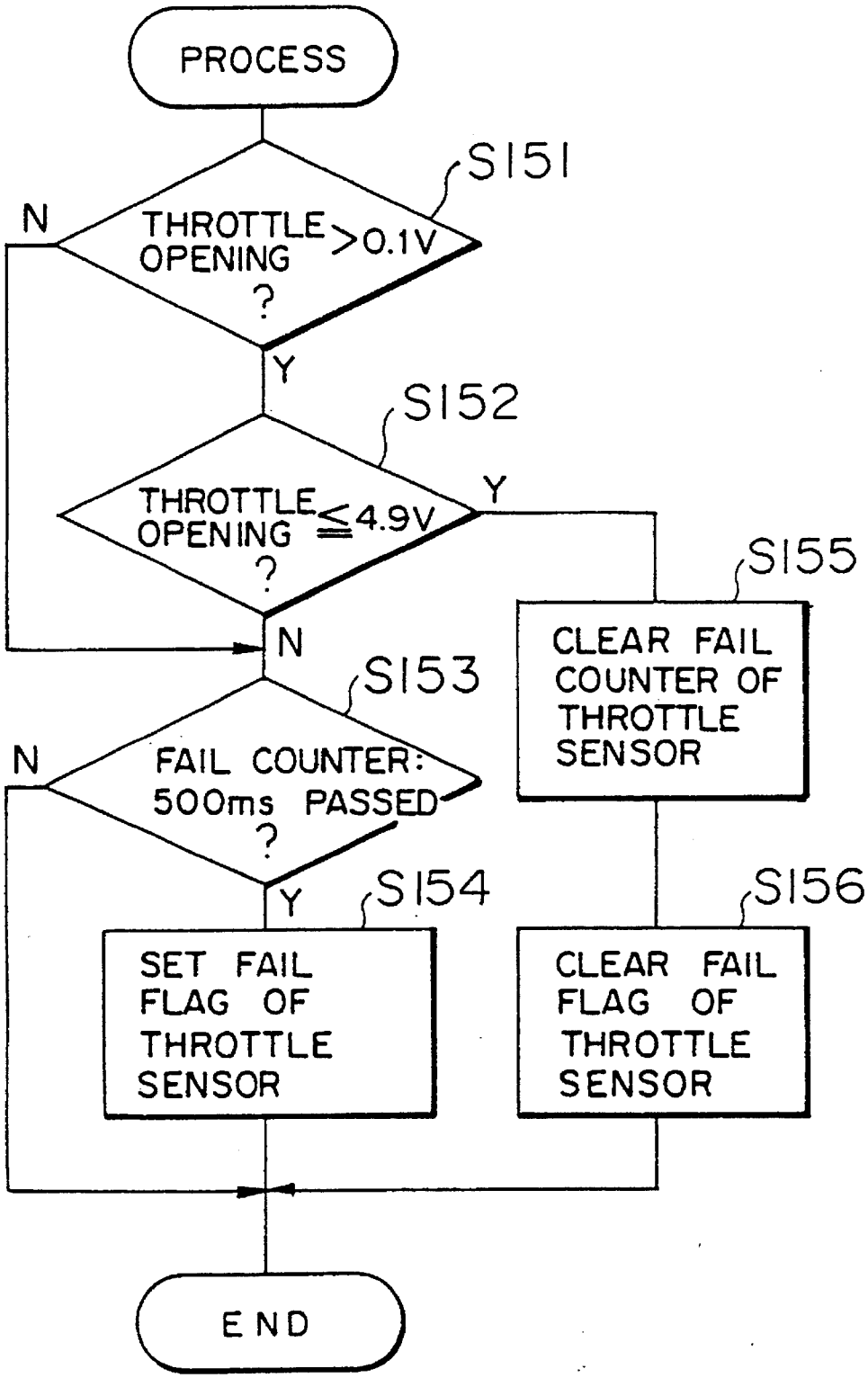
FIG. 11 is a program flowchart of the second embodiment.

FIG. 11 shows a program for detecting a malfunction of the throttle sensor as an example. In step (hereinafter referred to as S) 151 and S152, a check is made to determine whether a throttle opening signal is in the range from 0.1 V to 4.9 V. If the signal is in this range, the fail flag in the RAM 63 is cleared (S155, S156). If, on the other hand, the time during which the signal is not present in the above-mentioned range exceeds 500 ms (S153), it is assumed that the throttle sensor has a malfunction, and the fail flag is set (S154).

Figure 12:
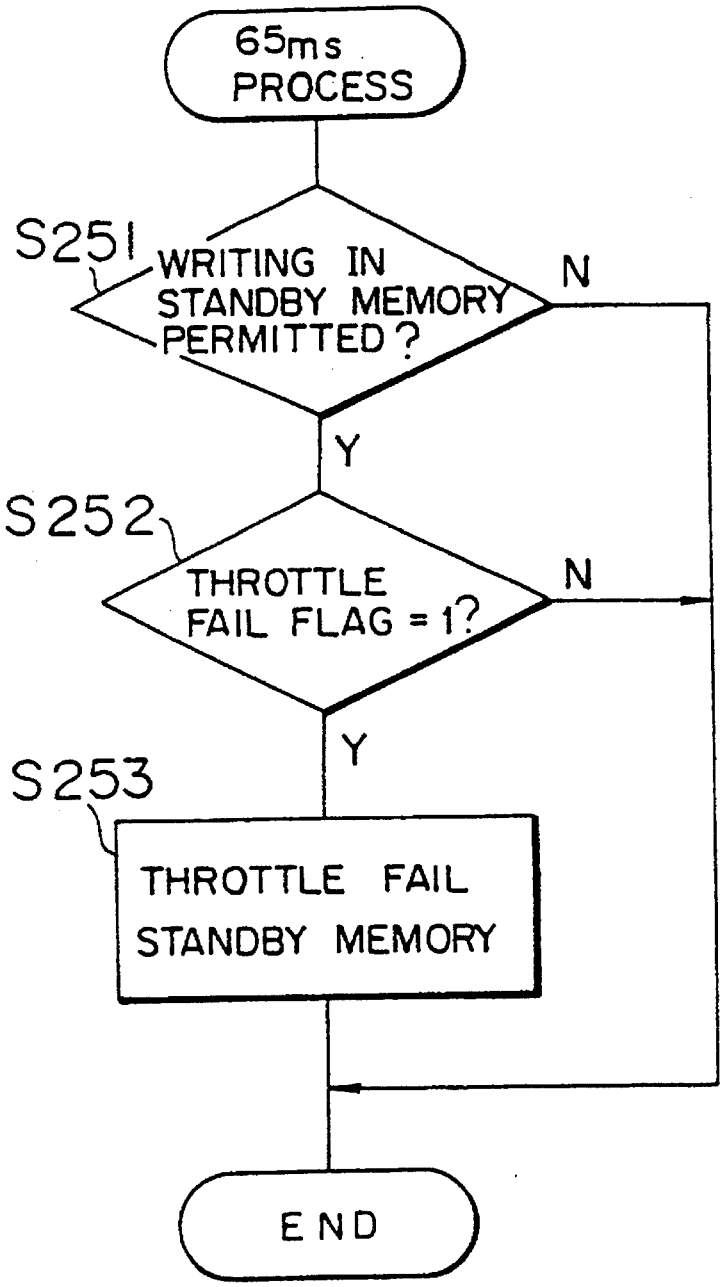
FIG. 12 is a program flowchart of the second embodiment.

FIG. 12 shows a program for inputting into the standby RAM the fact that the above-mentioned fail flag is set, which program is activated at intervals of every 65 ms. In S251, a check is made to determine whether writing in the standby RAM is possible. When the fail flag has been set, predetermined bits of the standby RAM are set (S252, S253), so that the fact that a specific instrument malfunctions has been detected is stored.

Figure 13:
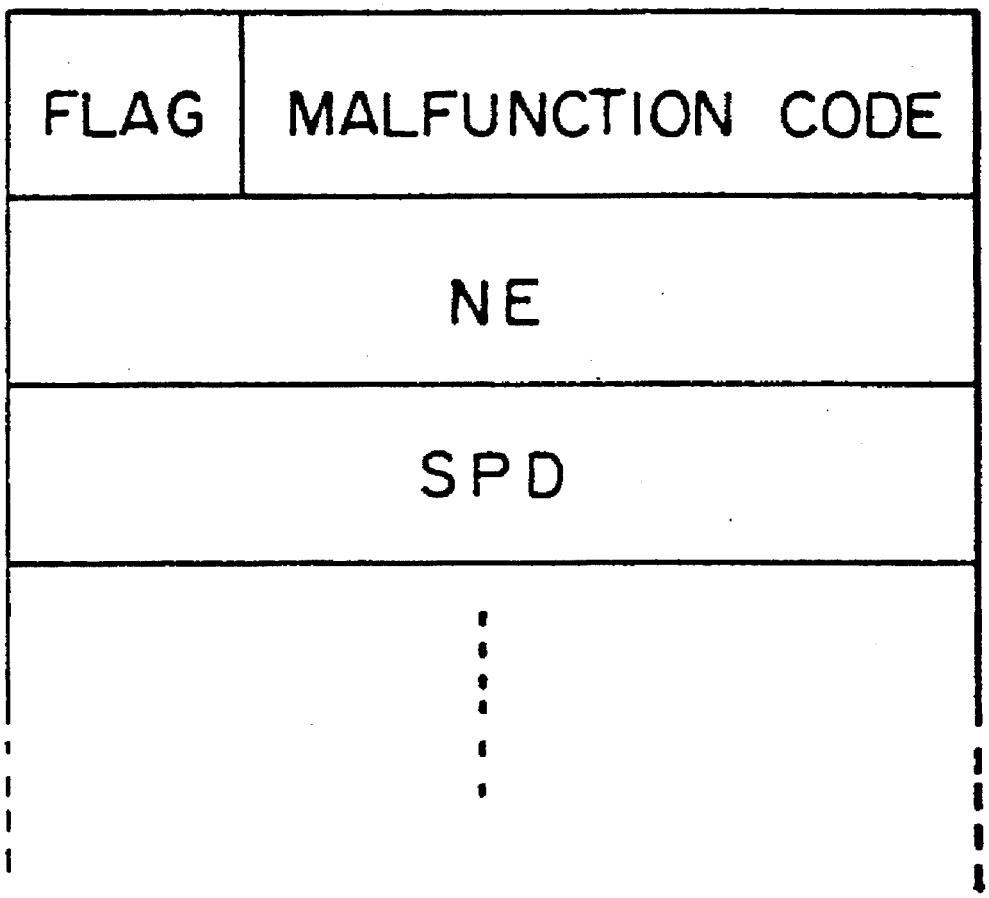
FIG. 13 is an illustration of the memory configuration of a standby RAM in accordance with the second embodiment.

The memory configuration of the standby RAM is shown in FIG. 13. A plurality of storage frames are secured in the standby RAM (one of which is shown in the figure). A flag bit, together with a malfunction code determined in accordance with the type of a malfunction, is set at the beginning address of each frame. Diagnostic data useful for analyzing the malfunction, such as the number of rotations of the engine (NE) or the speed (SPD) of the motor vehicle, is stored in sequence in the addresses after the beginning address. Each diagnostic data is stored in 8 or 16 bits.

Figure 14:
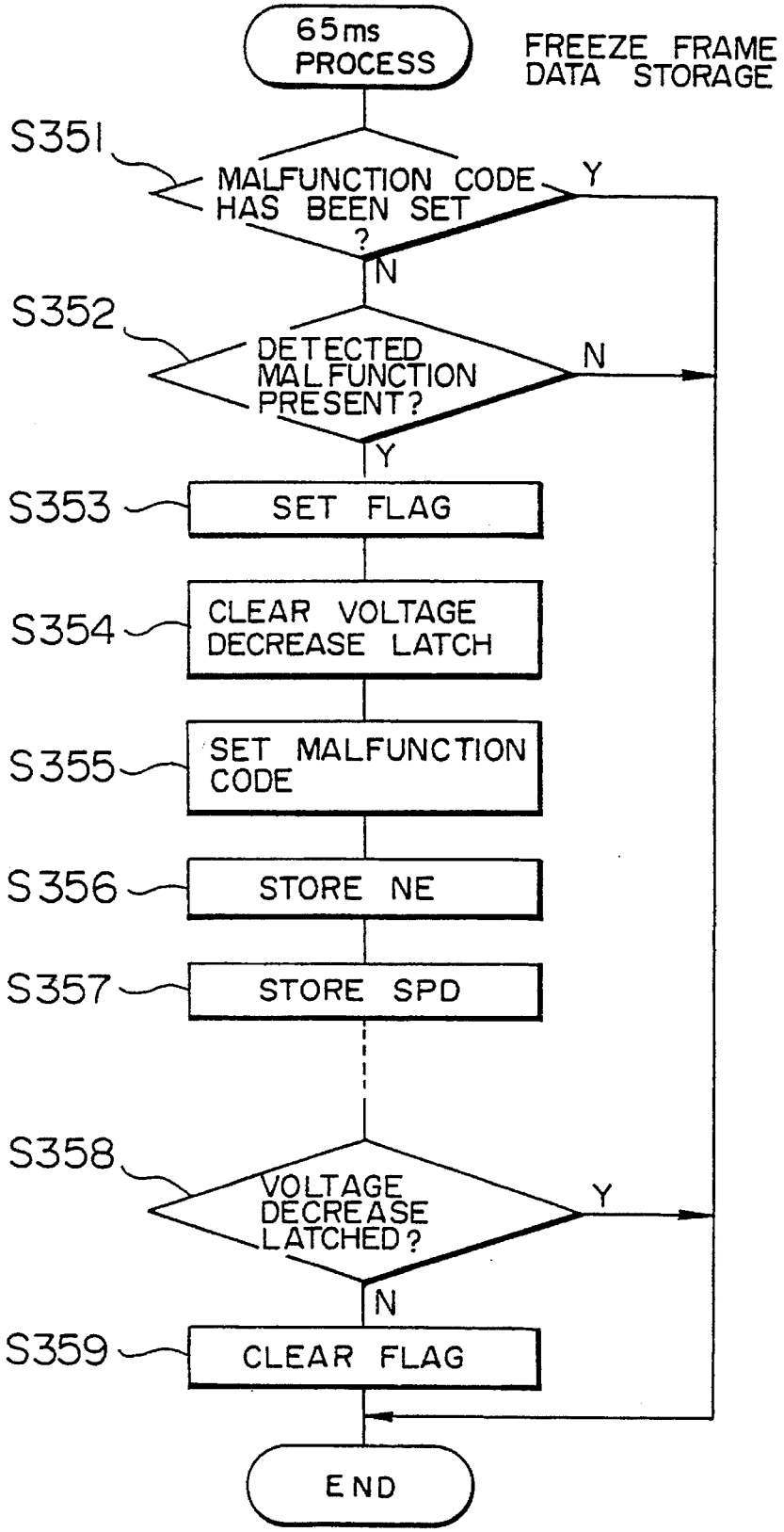
FIG. 14 is a program flowchart of the second embodiment.

FIG. 14 shows a program for controlling writing of diagnostic data in the standby RAM, which program is activated at intervals of every 65 ms. In S351, a check is made to determine whether the malfunction code has been set. If the malfunction code has not been set, a check is made to determine whether the predetermined bits of the standby RAM are set and a malfunction has been detected (S352). When the malfunction has been detected, the process proceeds to S353 and subsequent steps. In S353, a flag bit (FIG. 13) is set in the above-described beginning address, and then a voltage decrease latch within the I/O circuit 64 is cleared (S354).

In S355, the malfunction code is set, and then diagnostic data, such as the number of rotations of the engine (NE) or the speed (SPD) of the motor vehicle, is stored in sequence (S356, S357). In S358, a check is made to determine whether the voltage decrease latch has been set. If it has not been set, the above-mentioned flag bit is cleared (S359).

Figure 15:
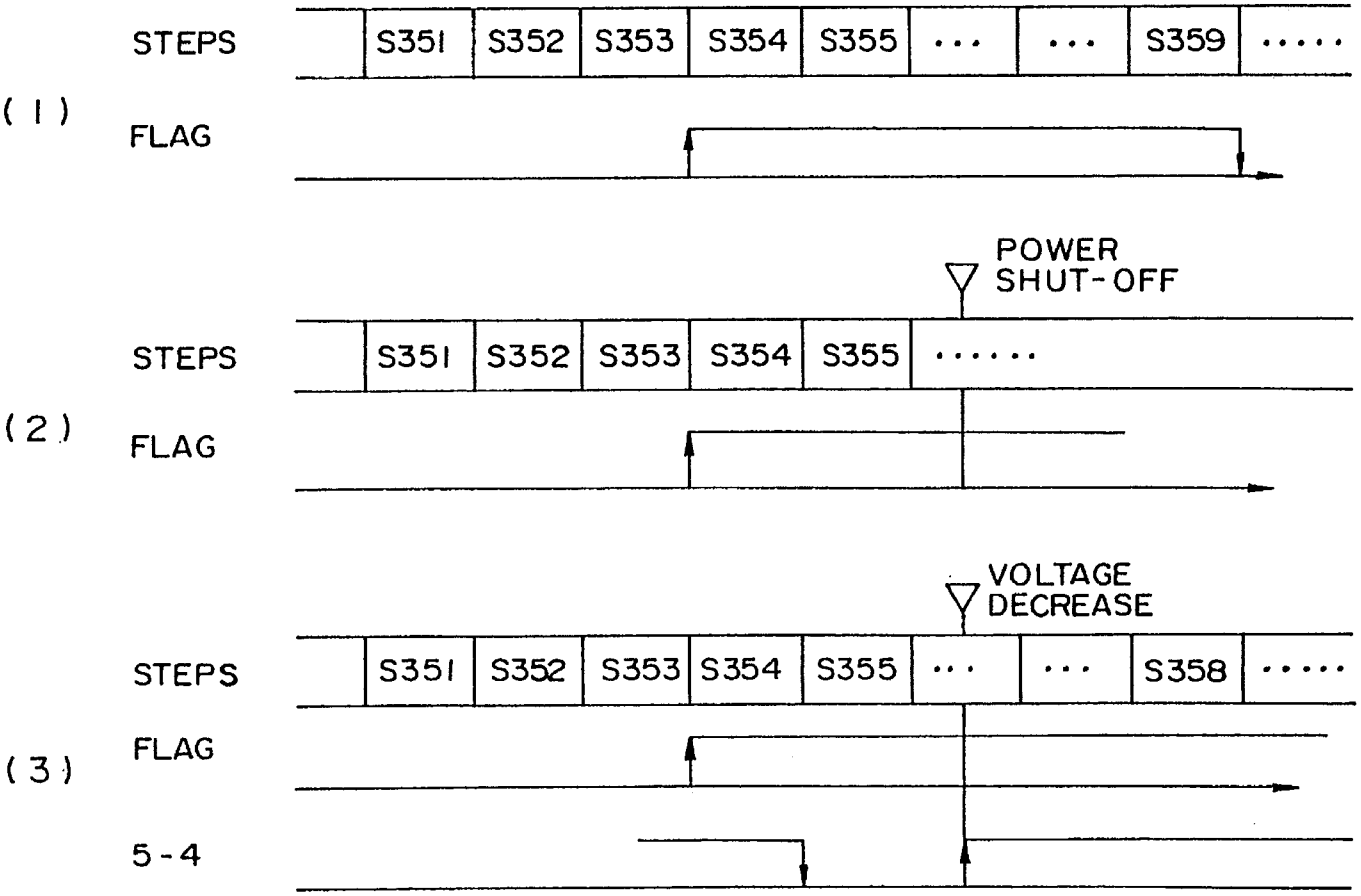
FIG. 15 is a timing chart of the second embodiment.

The chronological changes between the steps and the flag bit in the sequence of such operation are shown in (1) of FIG. 15. The flag bit set in S353 is reset in S359 after all the diagnostic data is stored.

FIG. 15 shows in (2) thereof a case in which the ignition switch is turned off while the diagnostic data is being stored. Since the program is not run after the power supply is shut off, the flag bit remains set.

FIG. 15 shows in (3) thereof a case in which the voltage of the power supply is decreased while the diagnostic data is being stored. Since the voltage decrease latch is set when the voltage is decreased, S359 is not executed, and the flag bit remains set.

Figure 16:
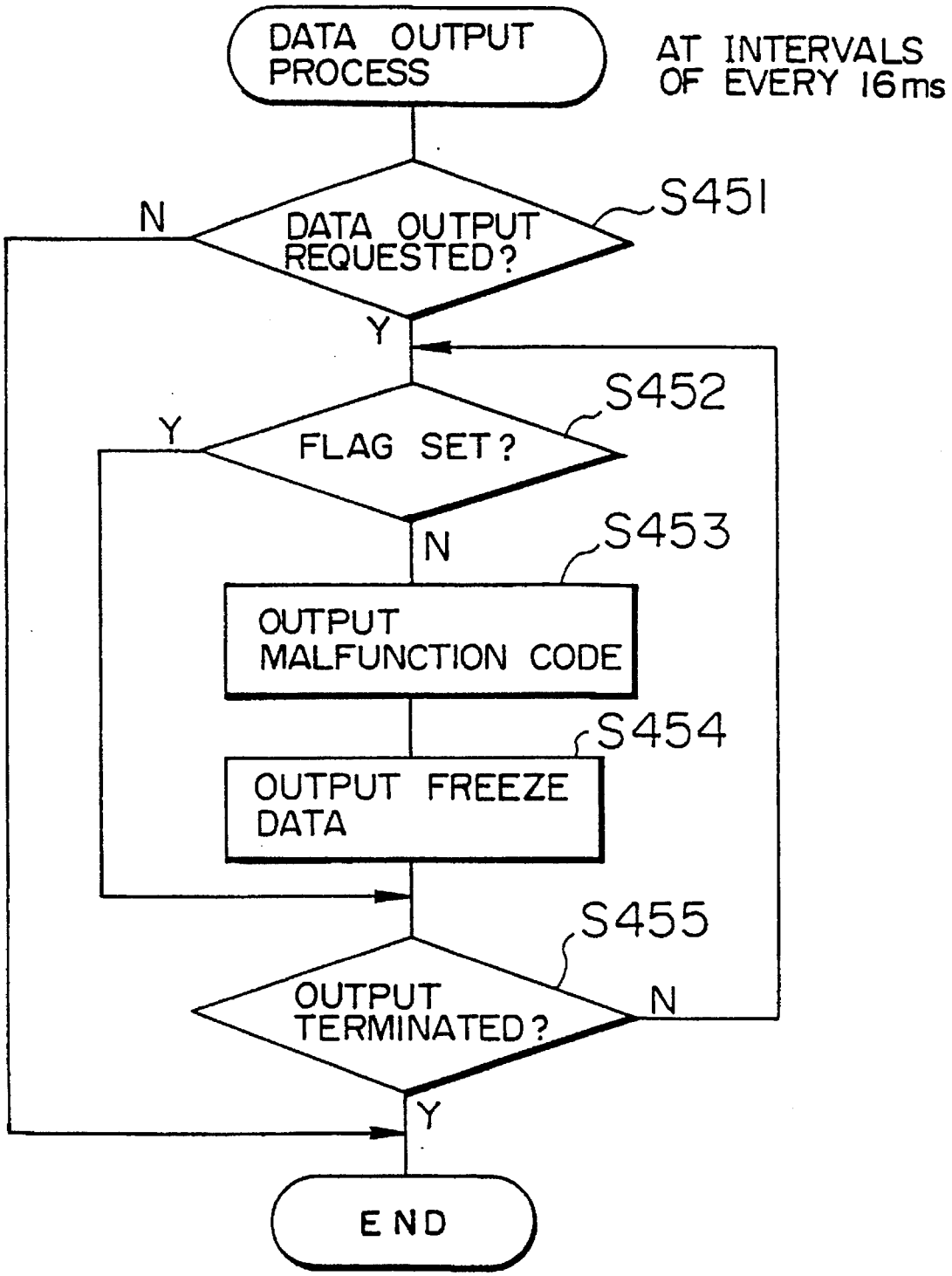
FIG. 16 is a flow chart of the second embodiment.

FIG. 16 shows a program for outputting diagnostic data from the control unit 51 side to the diagnostic checker 54 connected to the I/O circuit 64. A check is made in S451 to determine whether there has been a data output request from the diagnostic checker. When there has been a data output request, it is confirmed in S452 that the above-described flag bit has not been set in a storage frame to be output in S452, and the malfunction code and the frozen diagnostic data are read out (S453, S454). This is performed for all the storage frames, terminating data output (S455). Since the diagnostic data of the frame is not output if the flag bit has been set, outputting of data from the frame where erroneous data has been stored because the ignition switch has been turned off while data is being stored or the voltage is decreased can be prevented.

Figure 17:
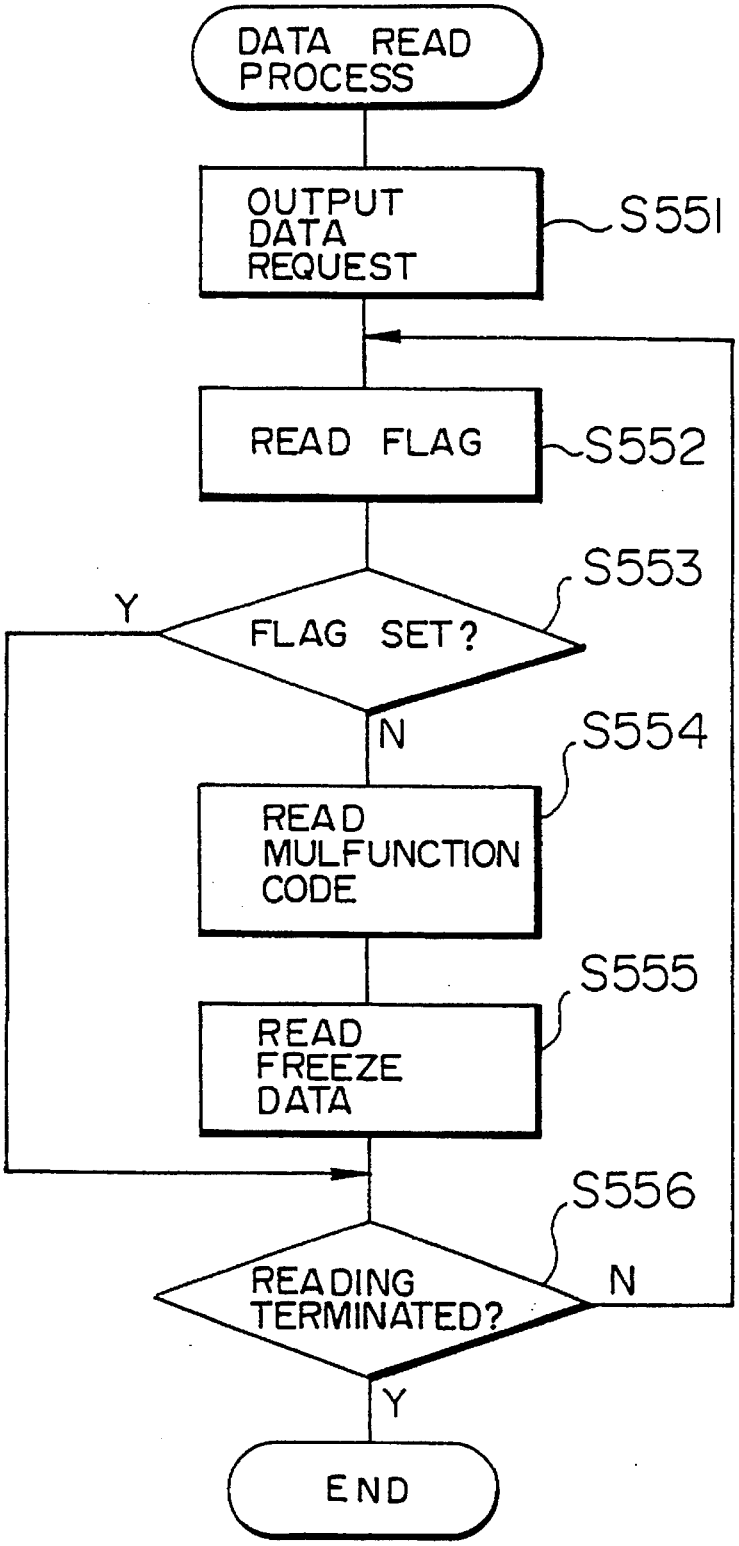
FIG. 17 is a flow chart of the second embodiment.
Figure 18:
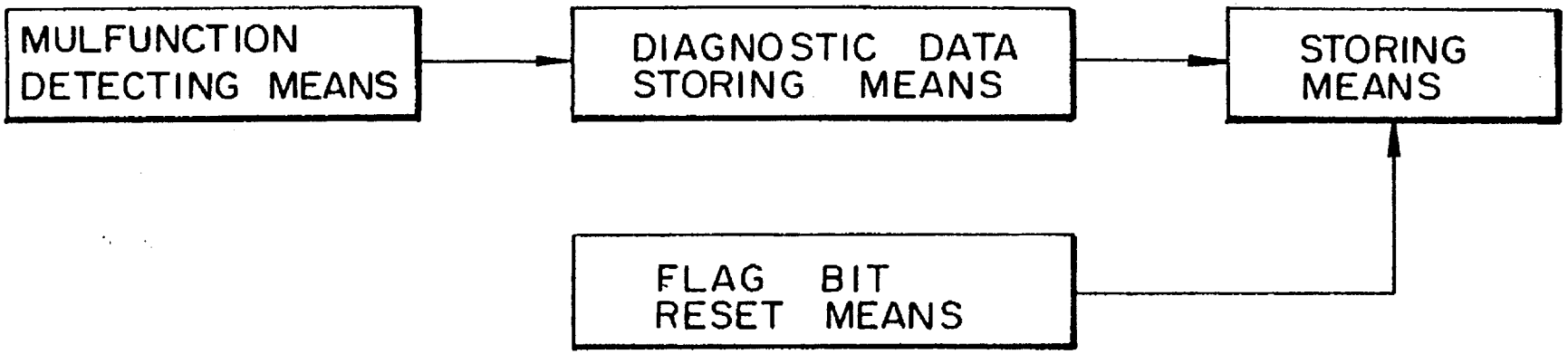
FIG. 18 is a block diagram illustrating the main functions of the second embodiment.

FIG. 16 shows an example in which a process for preventing erroneous data from being output from the control unit side is installed within the diagnostic data output process in the control unit 51 side. As shown in FIG. 17, it is also possible for the diagnostic checker 54 side to determine whether or not the data frozen in the control unit 51 is erroneous and then to read the data. According to FIG. 17, a data request is output to the CPU 61 of the control unit 51 in S551, and the flag bit is read out in S552. After it is confirmed that the flag bit has not been set, a malfunction code and diagnostic data are read out from the frame (S553, S554, S555). When the flag bit has been set, the diagnostic data is not read out. This is performed for all the storage frames, terminating outputting of data (S556). When the example of FIG. 17 is used, the control unit 51 does not perform such an output process as that shown in FIG. 16, but only outputs the flag, the diagnostic code and the freeze data in sequence in response to a request from the diagnostic checker.

In this embodiment, when there is an allowance for the operating voltage for the RAM, a voltage decrease need not necessarily be detected.

In the first embodiment, a check is made in S402 in FIG. 7 to determine whether or not the malfunction code has been set. Only when it has not been set, a check is made to determine whether the fail flag has been set. However, the determination by step 402 may be omitted so as to determine only the setting/non-setting of the fail flag. When the fail flag has been set, a malfunction code corresponding to the oldest fail flag may be set. In this case also, in the same way as in the first embodiment, data obtained when a malfunction occurs during trip can be maintained. To set and maintain a malfunction code corresponding to the oldest fail flag, a method in which the sequence of the occurrence for each fail flag is stored, or a method in which a malfunction code corresponding to the fail flag is set when the number of fail flags is one and the current malfunction code is maintained when the number of fail flags is two, may be used.

We claim:

1. A self-diagnosing apparatus for a motor vehicle, comprising:

diagnostic data detecting means for detecting diagnostic data necessary for analyzing malfunctions of instruments installed in said motor vehicle;

malfunction detecting means for detecting the malfunction state of said instruments installed in said motor vehicle;

malfunction detection history storing means for storing malfunction detection history of said malfunction detecting means and for holding the storage thereof even when an ignition switch is at an off state;

diagnostic data storing means for storing diagnostic data detected by said diagnostic data detecting means after the malfunction of said instruments installed in said motor vehicle is detected and for holding the storage thereof even when the ignition switch is at an off state; and diagnostic data manipulating means for controlling the diagnostic data stored in said diagnostic data storing means and for changing said diagnostic data in accordance with the presence or absence of temporary storage of said malfunction detection history.

2. A self-diagnosing apparatus for a motor vehicle according to claim 1, wherein said diagnostic data manipulating means confirms the presence or absence of the temporary storage prior to the storing by said diagnostic data storing means after the ignition switch is set at an on state, and inhibits the updating and storing process of said diagnostic data storing means when there is said temporary storage.

3. A self-diagnosing apparatus for a motor vehicle according to claim 1, wherein said diagnostic data storing means comprises:

a storing element for maintaining its storage even when the ignition switch is off;

updating means for updating and storing the diagnostic data detected by said diagnostic data detecting means in said storing element in sequence; and inhibiting means for inhibiting said updating and storing of the diagnostic data by said updating means in response to the detection of a malfunction by said malfunction detecting means.

4. A self-diagnosing apparatus for a motor vehicle according to claim 3, wherein said diagnostic data manipulating means confirms the presence or absence of the temporary storage prior to the storing by said diagnostic data storing means after the ignition switch is set at an on state, and inhibits an updating and storing process of said diagnostic data storing means when there is said temporary storage.

5. A self-diagnosing apparatus for a motor vehicle according to claim 1, wherein said diagnostic data manipulating means confirms the presence or absence of temporary storage of said malfunction detection history, and nullifies the diagnostic data stored in said diagnostic data storing means when said temporary storage is present.

6. A self-diagnosing apparatus for a motor vehicle according to claim 1, wherein said diagnostic data manipulating means confirms the presence or absence of temporary storage of said malfunction detection history, and determines the diagnostic data stored in said diagnostic data storing means to be nullified when said temporary storage is present and inhibits outputting thereof.

7. A self-diagnosing apparatus for a motor vehicle according to claim 1, wherein said diagnostic data storing means comprises:

a storing element for maintaining its storage even when the ignition switch is off; and setting means for storing the diagnostic data detected by said diagnostic data detecting means in said storing element in sequence in response to the detection of a malfunction by said malfunction detecting means.

8. A self-diagnosing apparatus for a motor vehicle according to claim 7, wherein said malfunction detection history storing means temporarily stores said malfunction detection history after said malfunction is detected by said malfunction detecting means, and erases said temporary storage after diagnostic data is stored in said storing element by said setting means.

9. A self-diagnosing apparatus for a motor vehicle according to claim 1, wherein said diagnostic data storing means stores the malfunction detection history of said malfunction detecting means together with said diagnostic data, separately from storage thereof by said malfunction detection history storing means.

10. A self-diagnosing apparatus for motor vehicles, comprising:

diagnostic data detecting means for detecting a plurality of diagnostic data necessary for analyzing malfunctions of instruments installed in a motor vehicle;

malfunction detecting means for detecting the malfunction state of said instruments installed in the motor vehicle;

storing means for storing said diagnostic data detected by said diagnostic data detecting means in response to the detection of a malfunction by said malfunction detecting means and for maintaining the contents of the storage even when the ignition switch is off;

interrupt detecting means for detecting that the storing of said diagnostic data by said storing means is interrupted; and diagnostic data manipulating means for controlling said diagnostic data stored in said diagnostic data storing means and for changing said diagnostic data in accordance with the detection by said interrupt detecting means.

11. A self-diagnosing apparatus for motor vehicles according to claim 10, wherein said diagnostic data manipulating means confirms detection of an interruption by said interrupt detecting means prior to the storing of said diagnostic data by said storing means after the ignition switch is put at an on state, and inhibits the storing of said diagnostic data by said storing means when said interruption there has been detected.

12. A self-diagnosing apparatus for motor vehicles according to claim 10, wherein said diagnostic data manipulating means confirms the detection of an interruption by said interrupt detecting means, and nullifies said diagnostic data stored in said storing means when said interruption has been detected.

13. A self-diagnosing apparatus for motor vehicles, comprising:

diagnostic data detecting means for detecting diagnostic data necessary for analyzing malfunctions of instruments installed in a motor vehicle;

malfunction detecting means for detecting the malfunction state of said instruments installed in the motor vehicle;

malfunction detection history storing means for storing the malfunction detection history of said malfunction detecting means and for maintaining the storage even when the ignition switch is off;

diagnostic data storing means for storing diagnostic data detected by said diagnostic data detecting means after a malfunction of said instruments installed in the vehicle is detected by said malfunction detecting means and for maintaining the storage even when the ignition switch is off; and updating inhibiting means for referencing the detection history stored in said malfunction detection history storing means after the ignition switch is turned on and for inhibiting the updating of the diagnostic data stored in said diagnostic data storing means when said detection history is stored therein.

14. A self-diagnosing apparatus for motor vehicles, comprising:

means for detecting a malfunction of each instrument installed in a motor vehicle;

storing means for maintaining the contents thereof even when the ignition switch is off;

means for setting a flag bit at a predetermined position of said storing means when said instrument malfunction is detected and then storing diagnostic data necessary for analyzing the instrument malfunction; and means for resetting said flag bit after all the diagnostic data is stored.

* * * * *